United States Patent [19]

Mühring et al.

[11] 4,002,034

[45] Jan. 11, 1977

[54] MATTING FOR THE PREVENTION OF HYDRAULIC EROSION

[76] Inventors: Walter Mühring, 20, Meppener Strasse, 45 Osnabruck; Ernst-Gunther Gossling, 18, Bachstrasse, 495 Dankersen, both of Germany

[22] Filed: June 25, 1975

[21] Appl. No.: 590,169

[30] Foreign Application Priority Data

June 27, 1974 Germany ..... 2431038

[52] U.S. Cl. ..... 61/3; 61/38; 137/512.15; 210/136; 210/170

[51] Int. Cl.[2] ..... C02B 3/12

[58] Field of Search ..... 61/37, 38, 5, 3, 4; 428/132, 137; 210/170, 136; 137/512.15, 512.14

[56] References Cited

UNITED STATES PATENTS

| | | | |
|---|---|---|---|
| 3,218,809 | 4/1965 | Rhodes et al. | 61/5 |
| 3,222,871 | 12/1965 | Miller et al. | 61/5 |
| 3,455,112 | 7/1969 | Twele | 61/37 |
| 3,517,514 | 6/1970 | Visser | 61/38 |
| 3,597,928 | 8/1971 | Pilaar | 61/4 |
| 3,670,506 | 6/1972 | Gandard | 61/35 |
| 3,696,623 | 10/1972 | Heine et al. | 61/38 |
| 3,754,362 | 8/1973 | Daimlir et al. | 61/11 |

*Primary Examiner*—Paul R. Gilliam
*Assistant Examiner*—A. Grosz
*Attorney, Agent, or Firm*—Pollock, VandeSande and Priddy

[57] ABSTRACT

A matting, anchored to the ground surface of an embankment adjacent a body of water for preventing erosion of said ground surface due to action of said water thereon, is so constructed that it provides less resistance to the flow of water therethrough in the direction from the ground surface toward the body of water than it does in the opposite direction from the body of water toward the ground surface. The preferential flow characteristic can be accomplished by providing the uppermost layer of the matting, facing the body of water, with a plurality of holes that are selectively covered by pressure responsive flaps. In the alternative, the preferential flow characteristic can be accomplished by providing the matting with plural layers of different fiber thickness and different pore spaces, with the uppermost layer of the matting having fibers of finest thickness and least pore spaces, and with the fiber thickness and pore spaces in the matting each increasing toward the base or ground side of the matting.

5 Claims, 9 Drawing Figures

MATTING FOR THE PREVENTION OF HYDRAULIC EROSION

Figure 1:
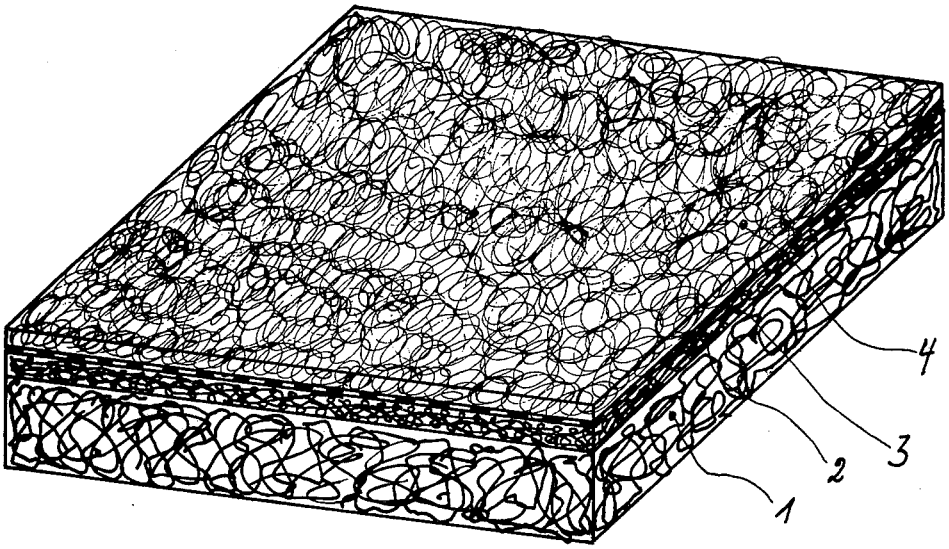

The present invention is concerned with the prevention of hydraulic erosion through the use of matting having a number of layers of felt with different pore spaces or pore volumes and fibres of different thicknesses, and a woven backing of synthetic fibre. The matting is anchored to the ground surface of an embankment adjacent a body of water, for preventing erosion of said ground surface due to the action of said water thereon.

Known types of multi-layer felt matting, used until now in hydraulic installations, have the disadvantage that filtration through the matting is unstable, especially when the adjacent body of water contains a high percentage of floating particles. These floating particles get caught up in the matting, reducing the flow therethrough and in some cases blocking the filter mats.

These known filter mats are capable of holding back the finest sand particles, but are unable to prevent the drift of sand down the banks. With underwater installations it often occurs that a layer of silt settles on the bare banks before the mats are fitted thereby endangering the security of the entire covering. In some cases the matting used may slide completely from the banks.

The above mentioned results cannot be avoided even by the use of filter matting having a layer of fibres with high pore space and of large thickness. Such matting is presently being used, mainly on the coasts, with the coarse fibre layer being disposed towards the adjacent body of water for holding back sand washed onto the shore. The mats are laid with the fine fibre layer down so as to become mingled with the ground, but here too the floating particles are trapped and retained in the filter layer causing a reduction in flow through or partial blockage of the matting with the negative result that the covering is unseated.

Beginning with this state of the art, it is the purpose of the present invention to provide a matting for the prevention of hydraulic erosion of the type mentioned so constructed that it does not become blocked by fine particles, that a stable connection between the matting and the ground is ensured, and that after a certain time stable mechanical and hydraulic conditions of the fibre matting and bank are established.

Washing-out of particles from the bank is to be avoided, and a reduction of excess pressure from the bank is to occur quickly and without damage to the bank. This purpose is achieved, according to the invention, in that a matting of the type mentioned is provided at its upper side, which faces towards the water, with a layer in which the resistance to the flow of fluid through it is substantially less in the direction from ground to water than in the opposite direction. In a preferred embodiment of the invention the uppermost layer of the matting consists of a flexible sheet or the like having holes which can be closed by means of flaps or the like arranged to cover the holes on the upper or water side of the sheet, whereby the flaps are pressed against the edges of the holes when the water flows from the upper side of the matting toward the ground and are lifted from the holes by a flow in the opposite direction, i.e., from the ground side. With such an embodiment a preferential direction of flow is ensured in a most effective manner. When a reduction of pressure occurs, the water from the ground side of the matting can flow easily to the water side of the matting. When the pressure on the water side of the matting increases, however, the flaps are closed whereby undesirable floating particles are prevented from entering the matting. The flexible cover sheet can be fabricated in two superposed layers, with the upper one of said layers being provided with said flaps and the lower one of said layers being provided with said holes.

In another practical embodiment of the invention, the same effect is achieved by providing the matting with a topmost layer of felted fibres of fine thickness and by constructing the matting to exhibit a continuously increasing pore volume toward the base or ground side of the matting. With this solution it is possible for the water to flow in the dam direction. The fine, floating particles however, are caught in the upper fine-filter zone of the matting, and are washed out again when the direction of flow is reversed.

Thus the filter remains free and pressure build-up is avoided.

For ensuring a reliable connection between the protective matting and the ground it has proved effective that the undermost or base layer of the matting is made up of fibres of coarse thickness, for example, as thick as coconut fibres.

Furthermore, it is possible to achieve a preferred direction of flow through the matting by providing the topside of the filter mat with flexible, long-fibred tufts which lie on the ground surface, blocking it to downward flow toward the ground, but rise and permit flow through the matting from ground to water as the pressure dictates.

In the following, preferred embodiments of the invention are described in detail with the aid of the drawings wherein:

FIG. 1 is a perspective view of a section of a first embodiment of the protective matting of the present invention.

Figure 2:
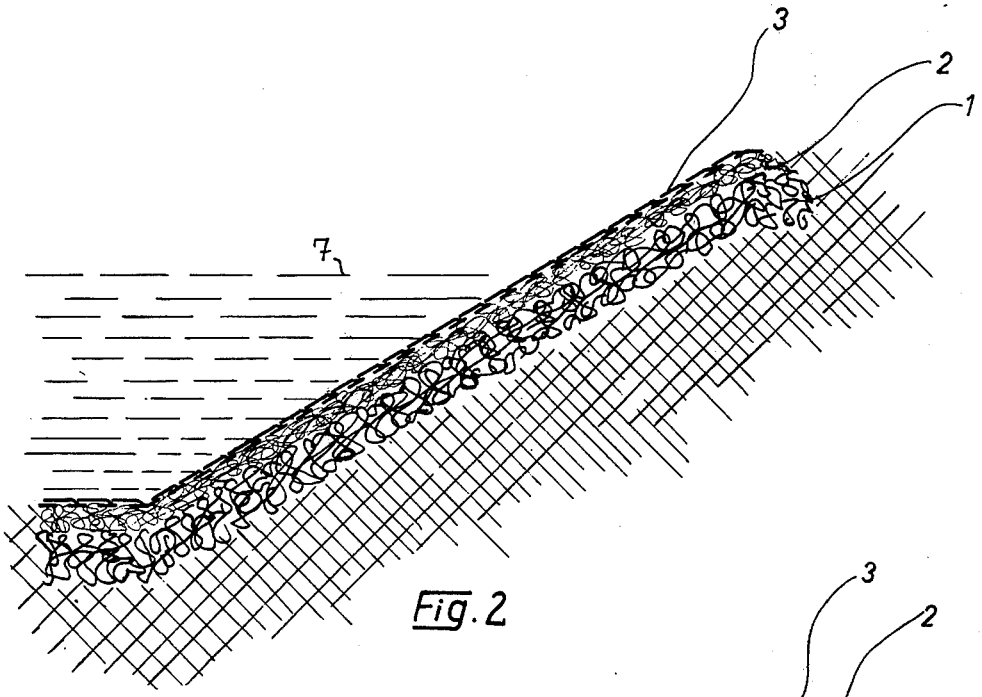
Figure 3:
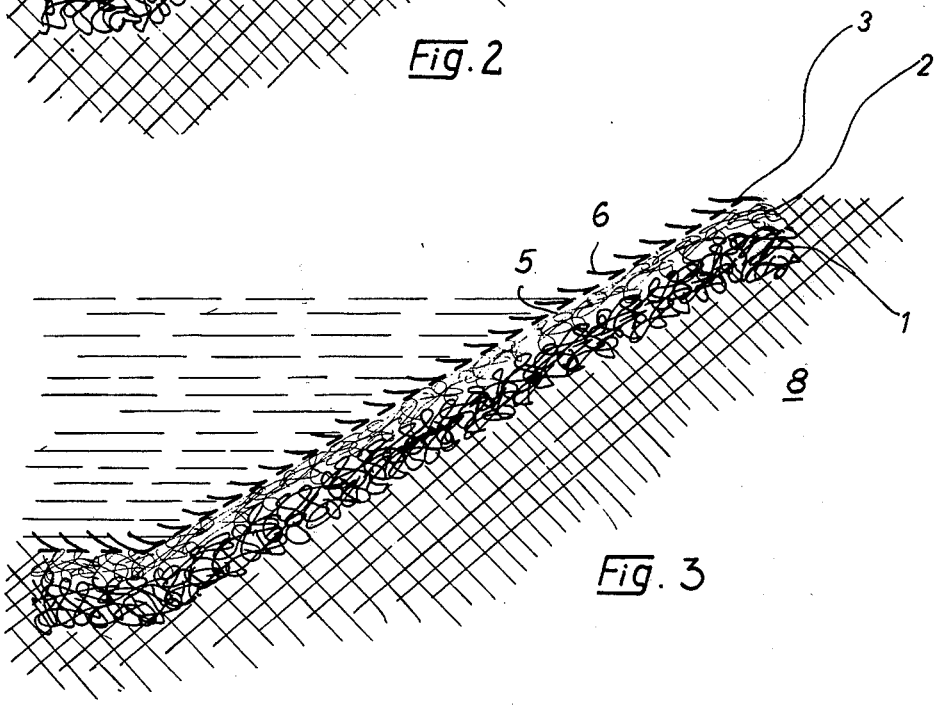
Figure 4:
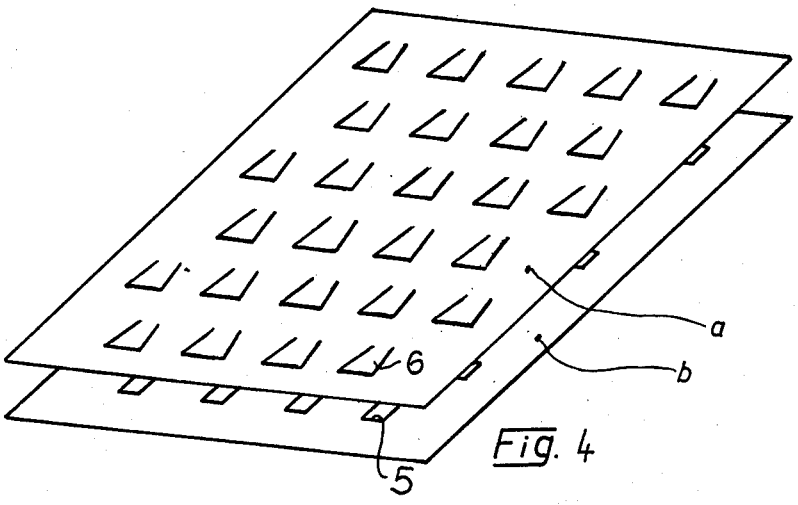
Figure 5:
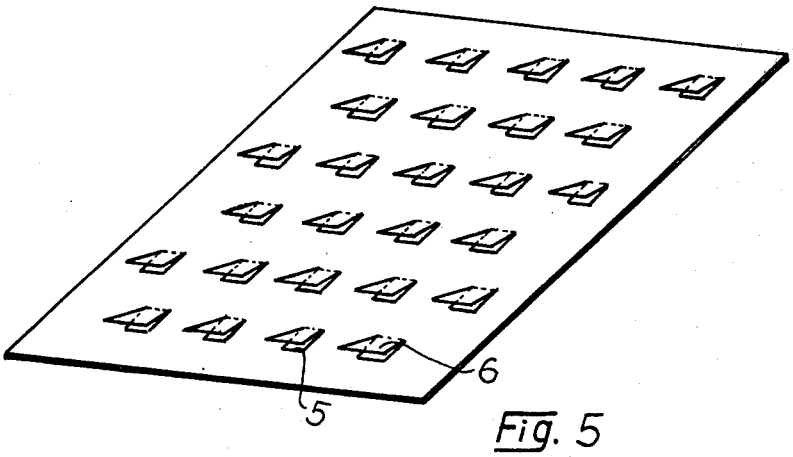
Figures 6, 7:
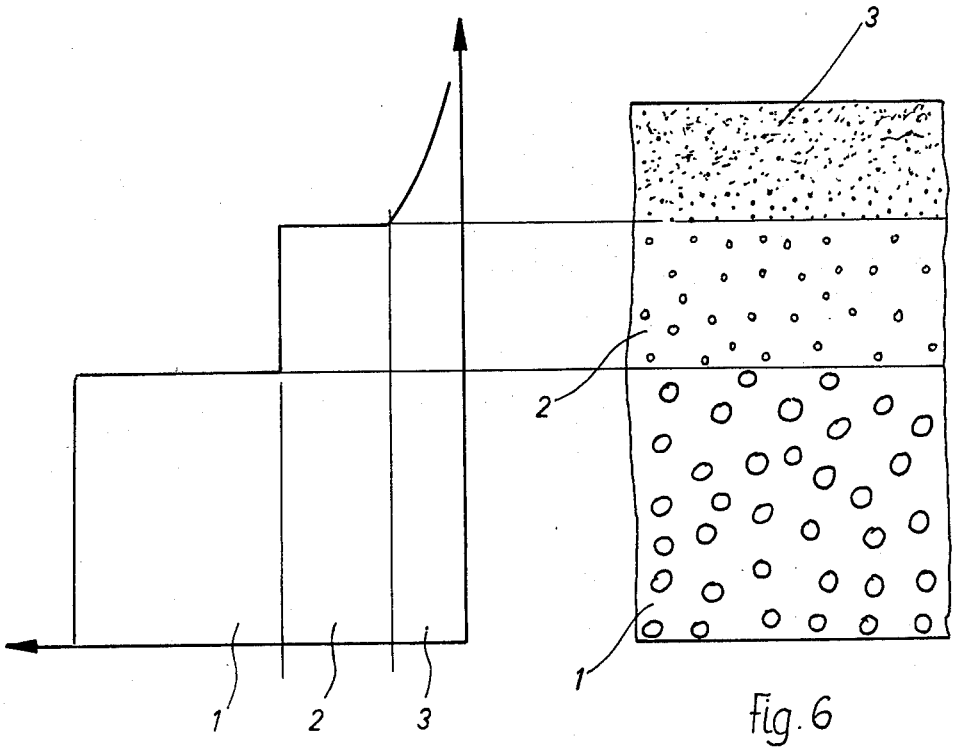
Figure 8:
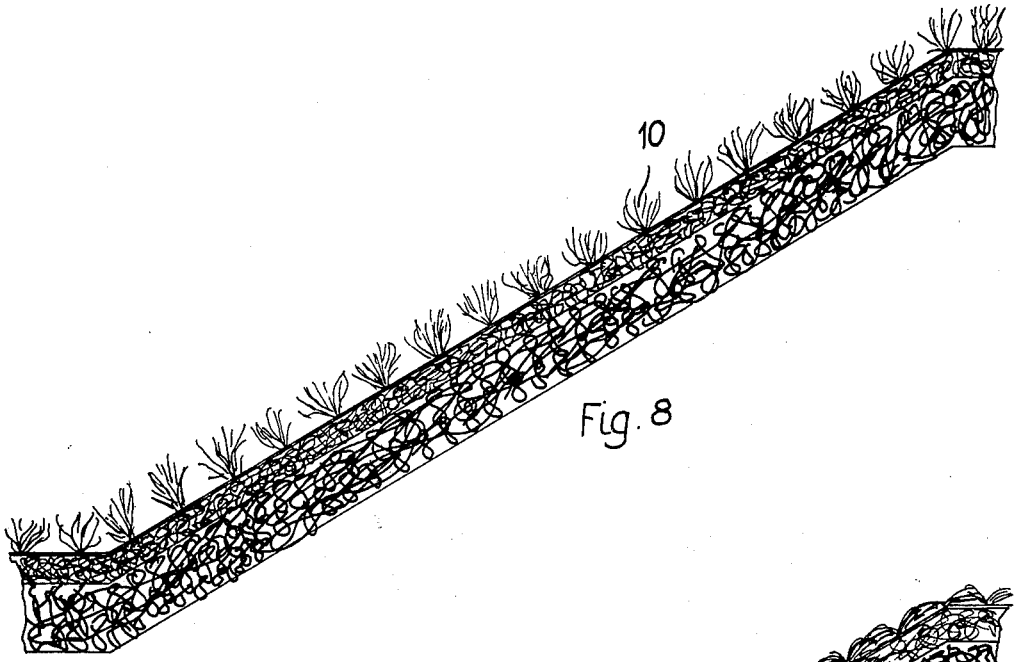
Figure 9:
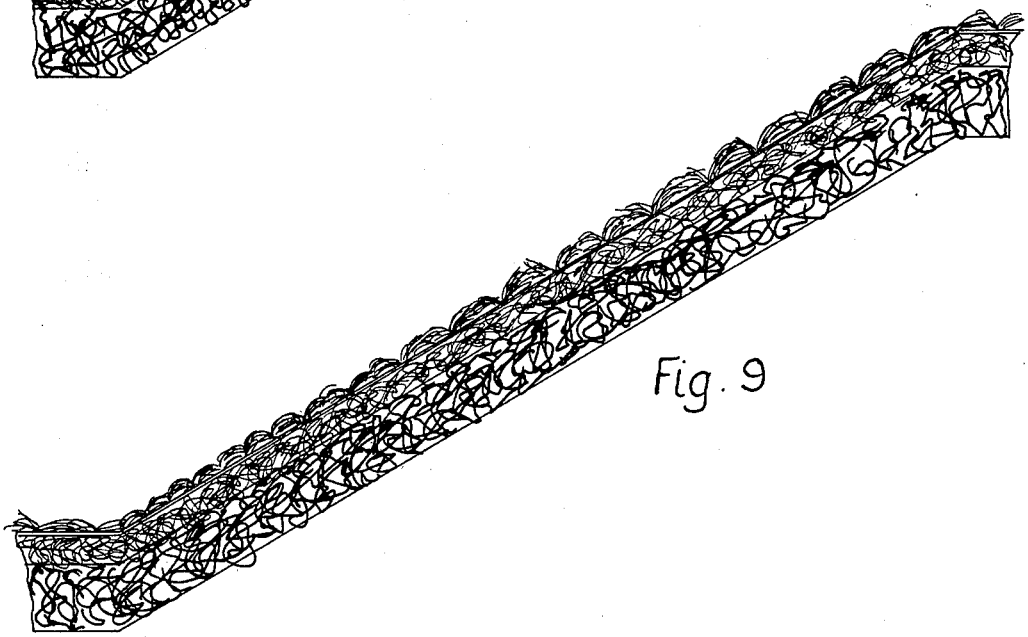

FIG. 2 illustrates a second embodiment of the matting provided with closure flaps on a cover sheet, in closed condition, FIG. 3 is a view similar to FIG. 2 but with the flaps open, FIG. 4 is a view of the two-layer cover sheet with flaps, FIG. 5 depicts the cover sheet of FIG. 4 with both layers together, FIG. 6 is a section through a filter mat constructed in accordance with the present invention provided with an upper layer and continuously decreasing pore volume, FIG. 7 is a schematic illustration showing the relationship between the thickness of the fibres and the pore volume in the mat shown in FIG. 6, FIG. 8 is a further embodiment of erosion prevention matting, with flow from the embankment, and FIG. 9 depicts the protective matting FIG. 8, with flow toward the embankment.

In the embodiment of FIG. 1, the matting of the present invention comprises a first layer 1 of coconut fibres of coarse thickness which forms the base of the matting. On this first layer, a second layer 2, using fibres of a lesser thickness, is felted. A woven backing 3 is secured to the second layer 2. Above the woven backing 3 there is a layer of fine fibres 4, the pore volume of which decreases towards the top or water side of the matting to a degree such that fine particles from the water are held at the uppermost surface. The term "pore volume" as used herein means that volume, or pore space, in the matting which is occupied by air.

In a second embodiment of the invention, shown in FIGS. 2 and 3, the first and second layers 1 and 2 are the same as in the embodiment of FIG. 1. A cover in the form of a sheet is provided, however with holes 5 which can be closed by means of flexible closure flaps 6. In FIG. 2, the mat is shown with pressure acting from the side of the water 7, and in FIG. 3 pressure is acting from the side of the embankment 8. The schematically indicated operation of the flaps can be realised by constructing the cover from two adjacent sheets *a* and *b* as shown in FIGS. 4 and 5. The holes 5 are provided in the sheet *b* and are smaller than the cut-out portions for the flaps 6 provided in the sheet *a*. By this means the holes are reliably covered.

In FIG. 6 a vertical section through an embodiment similar to that of FIG. 1 is shown. The matting of FIG. 6 consists of three layers, with the lowest layer 1 having the largest pore volume or pore spaces and being provided with fibers of the greatest thickness. The porosity of layer 1 is constant throughout said layer 1. A second layer 2 is superposed on layer 1, and said layer 2 also has a constant porosity throughout but exhibits smaller pore spaces than that of layer 1. On top of layer 2 is provided a third layer 3 having fibers which are even smaller and thinner than those employed in layers 1 and 2 and, in contrast to layers 1 and 2, the pore volume of the third layer 3 is not constant throughout its thickness but, instead, continuously decreases toward the uppermost side of the matting. The pore volume of the top, fine-fibred layer 3 of this embodiment thus decreases gradually toward the water side, whereas the increase in pore volume is in large steps in the case of the two layers 1 and 2 towards the ground side of the matting. The operational result of this arrangement is shown in FIG. 7 wherein the pore volume (plotted on the horizontal axis of FIG. 7) is shown as a function of the overall thickness of the filter mat. As illustrated in FIG. 7, the pore volume of the lowermost layer 1 is comparatively large and of constant value, the pore volume of the intermediate layer 2 is also of constant value but of lesser magnitude, and the pore volume of the uppermost layer 3 is not constant and decreases toward the uppermost surface of the matting.

With the embodiment according to FIGS. 8 and 9 the role of the flaps 6 is performed by the tufts 10. More particularly, in the embodiment of FIGS. 8 and 9 the matting has an uppermost layer which is provided with long-fibered tufts 10. FIG. 8 shows the position of these tufts in the absence of any flow of water through the matting, i.e., when the water is still. If the flow of water is directed through the filter-matting toward the ground surface, however, the long-fibered tufts will tend to lay on the outermost or water side of the matting, as shown in FIG. 9, so as to operate in a manner similar to the closure flaps of the embodiments of FIGS. 2–5 to impede the flow of water through the matting toward the ground surface. When the flow is from the ground side the tufts are lifted as shown in FIG. 8.

Good hydraulic filtering stability can be achieved with the embodiment shown in FIG. 6 when the ratio of open to closed surface area is about 2:100.

We claim:

1. A protective matting laid on a ground surface adjacent a body of water for inhibiting hydraulic erosion of said ground surface, said matting comprising at least two superposed fibrous layers, the fibers employed in the one of said layers closest to said ground surface being thicker than those in the other of said two layers more remote from said ground surface, and the spacing between the thicker fibers in the one of said layers closest to said ground surface being greater than the spacing between the thinner fibers in the other of said layers more remote from said ground surface, and said matting including a third layer disposed outwardly of said two fibrous layers relative to the ground surface and constructed to provide a preferential direction of water flow through said matting with the resistance to water flow through said matting in a direction from the ground surface side of said matting toward the water surface side of said matting being less than the resistance to water flow through said matting in a direction from the water surface side of said matting toward said ground surface side of said matting wherein said third layer is positioned adjacent the uppermost surface of said matting facing said body of water and comprises a flexible layer having a plurality of perforations therein, said third layer further comprising means providing a plurality of flexible closure elements extending outwardly from said uppermost surface toward said body of water and adapted to selectively cover underlying associated ones of said perforations respectively in response to flow of water through said matting from said body of water toward said ground surface, and adapted to uncover said associated perforations respectively in response to flow of water through said matting from said ground surface toward said body of water.

2. The matting of claim 1 wherein said third layer comprises a pair of superposed sheets of flexible material, the outer one of said sheets defining a plurality of spaced hinged flaps acting as said closure elements, and the inner one of said sheets defining a plurality of perforations spaced from one another in accordance with the spacing of said flaps.

3. The matting of claim 1 wherein said third layer comprises a mass of comparatively fine fibers arranged in a felted configuration having a pore volume less than that of either of the other two layers in said matting, said closure elements comprising a plurality of long-fibered tufts outstanding from the outermost surface of said flexible layer.

4. The matting of claim 3 wherein the comparatively fine fibers in said third layer are variably spaced from one another to exhibit a variable pore volume, the pore volume in said third layer gradually increasing from the water side of said matting in a direction toward the ground side of said matting.

5. The matting of claim 4 wherein the pore volume has a substantially constant value in each of the two additional fibrous layers in said matting, the value of the pore volume in the fibrous layer closest to said ground surface being greater than the value of the pore volume in the other of said two fibrous layers, and the value of the pore volume in the other of said two fibrous layers being greater than the maximum pore volume in said third layer.

* * * * *